US007357262B2

(12) United States Patent
Fratilla

(10) Patent No.: US 7,357,262 B2
(45) Date of Patent: Apr. 15, 2008

(54) HANGING STORAGE SYSTEM

(76) Inventor: Brian J. Fratilla, 13224 Via Santillana, San Diego, CA (US) 92129

( * ) Notice: Subject to any disclaimer, the term of this patent is extended or adjusted under 35 U.S.C. 154(b) by 245 days.

(21) Appl. No.: 11/366,311

(22) Filed: Mar. 2, 2006

(65) Prior Publication Data

US 2007/0205169 A1 Sep. 6, 2007

(51) Int. Cl.
*A47F 5/08* (2006.01)

(52) U.S. Cl. ..... 211/117; 211/189; 211/207

(58) Field of Classification Search ..... 211/113, 211/117, 118, 119, 175, 189, 207, 208; 108/42, 108/149, 186; 52/39
See application file for complete search history.

(56) References Cited

U.S. PATENT DOCUMENTS 2,057,092 A * 10/1936 Geib ..... 182/113
3,139,045 A * 6/1964 Rojakovick ..... 108/109
3,735,951 A * 5/1973 Reed ..... 248/340
3,945,462 A * 3/1976 Griswold ..... 182/150
4,142,705 A * 3/1979 Miller ..... 249/188
4,167,908 A * 9/1979 Jones et al. ..... 108/182
4,441,583 A * 4/1984 Vaught ..... 182/150
5,749,479 A * 5/1998 Belokin et al. ..... 211/113
6,145,678 A * 11/2000 Morrison ..... 211/113
6,435,105 B1 * 8/2002 Mikich et al. ..... 108/42
6,715,427 B2 * 4/2004 Mikich et al. ..... 108/42
6,725,608 B1 * 4/2004 Kraus ..... 52/36.4

* cited by examiner

*Primary Examiner*—Jennifer E. Novosad
(74) *Attorney, Agent, or Firm*—Steven W. Webb

(57) ABSTRACT

A hanging storage system is presented with ceiling attachment strips that can be cut to fit a variety of storage spaces, that possesses attachment brackets long enough to span two or more roof support trusses, and with a C-shaped beam on its long axis designed to permit the system to carry increased weight of stored items.

2 Claims, 4 Drawing Sheets

HANGING STORAGE SYSTEM

FIELD OF THE INVENTION

This invention relates to the area of storage systems for home and industrial use, specifically those designed to be retrofitted to existing structures, such as garages or storage units.

BACKGROUND OF THE INVENTION

The typical storage scenario involves identifying square footage of a building to be set aside for storage, where items will be stacked on the floor. A storage structure supported from the ceiling of a building increases the capacity of storage space by permitting items to be placed well above the floor, for example in the ceiling area of a garage.

There is a long history of such storage structures in the art, including U.S. Pat. Nos. 6,715,427 and 6,435,105 to Mikich, et al. and U.S. Pat. No. 6,725,608 to Kraus. These are the most recent inventions, and they primarily address the garage ceiling storage problem. Each has their own mechanism for attachment to the ceiling rafters, and unique rack designs.

The present invention adapts the state of the art and moves it forward by supplying improved angle iron connectors for rafter support and an optional improved, C-shaped three-sided horizontal beam support to prevent bowing of the support rack.

SUMMARY OF THE INVENTION

Current models of ceiling storage racks for garages share some general design characteristics: they fasten to garage ceilings at 4 or 6 points with vertical risers descending to connect with four horizontal members that form a rectangular frame. The risers can be adjusted for length to match slanted rafter beams and the like.

A metal screen or wire mesh is placed over the frame to serve as the floor of the storage space. The screen is designed to support loads of a stated weight.

Several of the state of the art rack systems can not be connected to a ceiling where rafters were set at nonstandard separations. The mounting brackets are usually four inches in width and where the ceiling trusses are at distances of other than 16" or 24", they were not large enough to permit attachment such that the risers would descend and form a rectangular shape to connect to the support frame. The current invention allows installers to place the attachment brackets and hence the risers at any point.

The present invention provides a ceiling attachment bracket capable of spanning the required ceiling truss separation, usually 16" to 24". This is done with a special angle iron fitted with two connection points. The installation process is made easier and a stronger, and a two-connection-point attachment is made with the truss. This attachment strategy increases the load capacity of the present invention over competing designs.

The attachment point holes on the ceiling attachment bracket are not placed in parallel rows, but are staggered such that a better connection with the center of the support truss can be attained. In the preferred embodiment, bolts are driven through the attachment point holes to make the connection with the truss. In an alternative embodiment, attachment holes can be slotted.

Note that in the Mikich patents, the "adapters" provided are very short, and will not account for multiple-beam connection with beams that are a nonstandard distance apart. The present invention provides significantly wider attachment brackets instead of adapters, permitting the installer to find a much more convenient attachment point for placing bolt holes closer to the center of the ceiling truss. For example, the holes on the Mikich adapter are in a single line unlike the present invention's staggered double line, which provides a significantly more useful attachment ability, permitting the installer to pick a drilling point closer to the center of the ceiling truss for maximum security.

The invention also possesses in an alternate embodiment a three-sided, C-shaped longitudinal beam for the support rack frame, providing substantial strength improvements over the standard two-sided angle iron

BRIEF DESCRIPTION OF THE DRAWINGS

The features of this invention will be best understood from the accompanying drawings, taken in conjunction with the accompanying description.

DESCRIPTION OF THE PREFERRED EMBODIMENT

Figure 1:
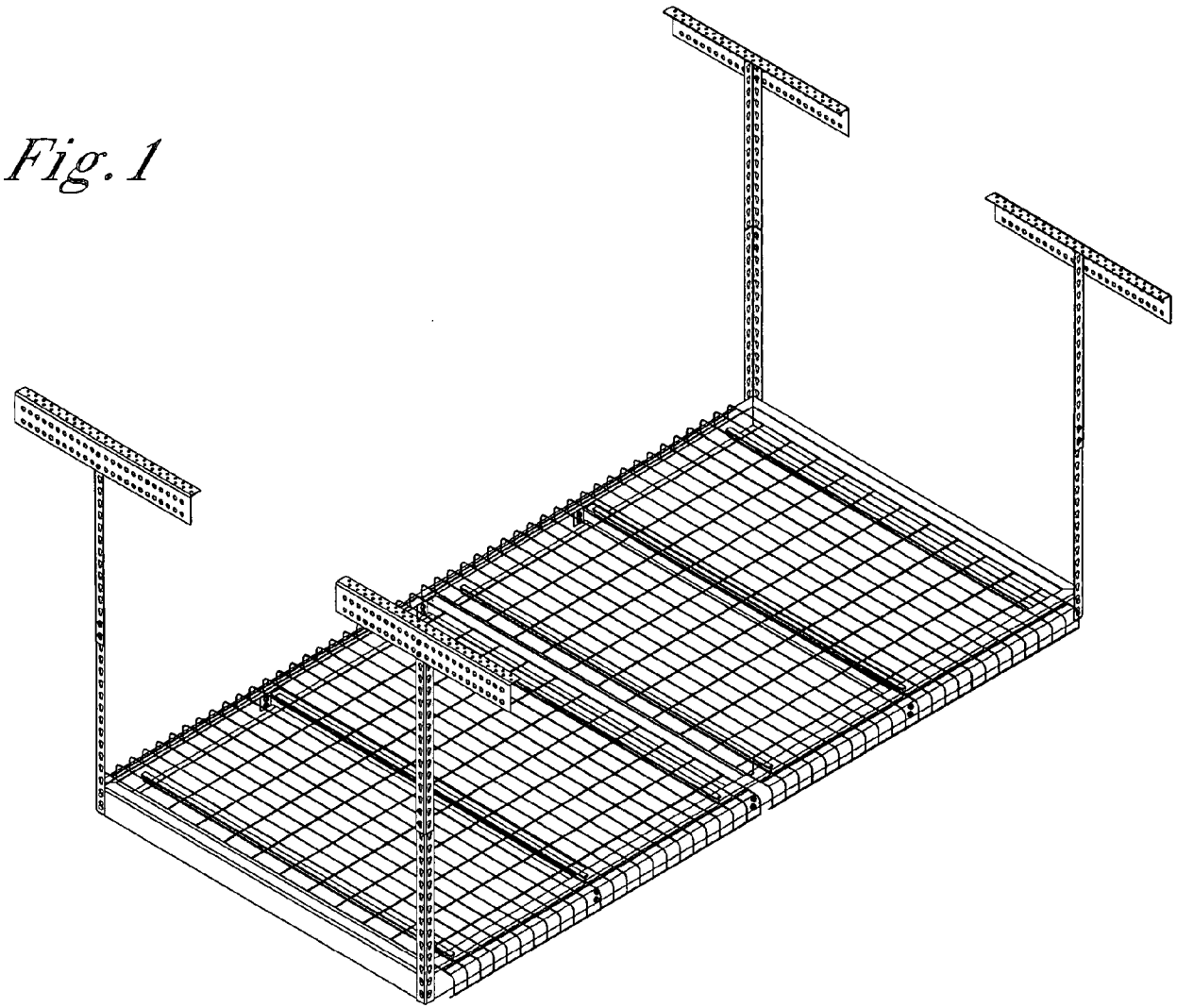
FIG. 1 is a perspective view of the invention

The present invention is shown in a perspective overview in FIG. 1. The invention 100 consists of the four ceiling attachment brackets 101, four adjustable risers 102 dropping from the attachment brackets 101, a set of cross members 105 and a frame 103,104, and on top of the assembled frame 103,104 and cross members 105 a screen of metal mesh 106 to support items carried by the storage system.

Figure 2:
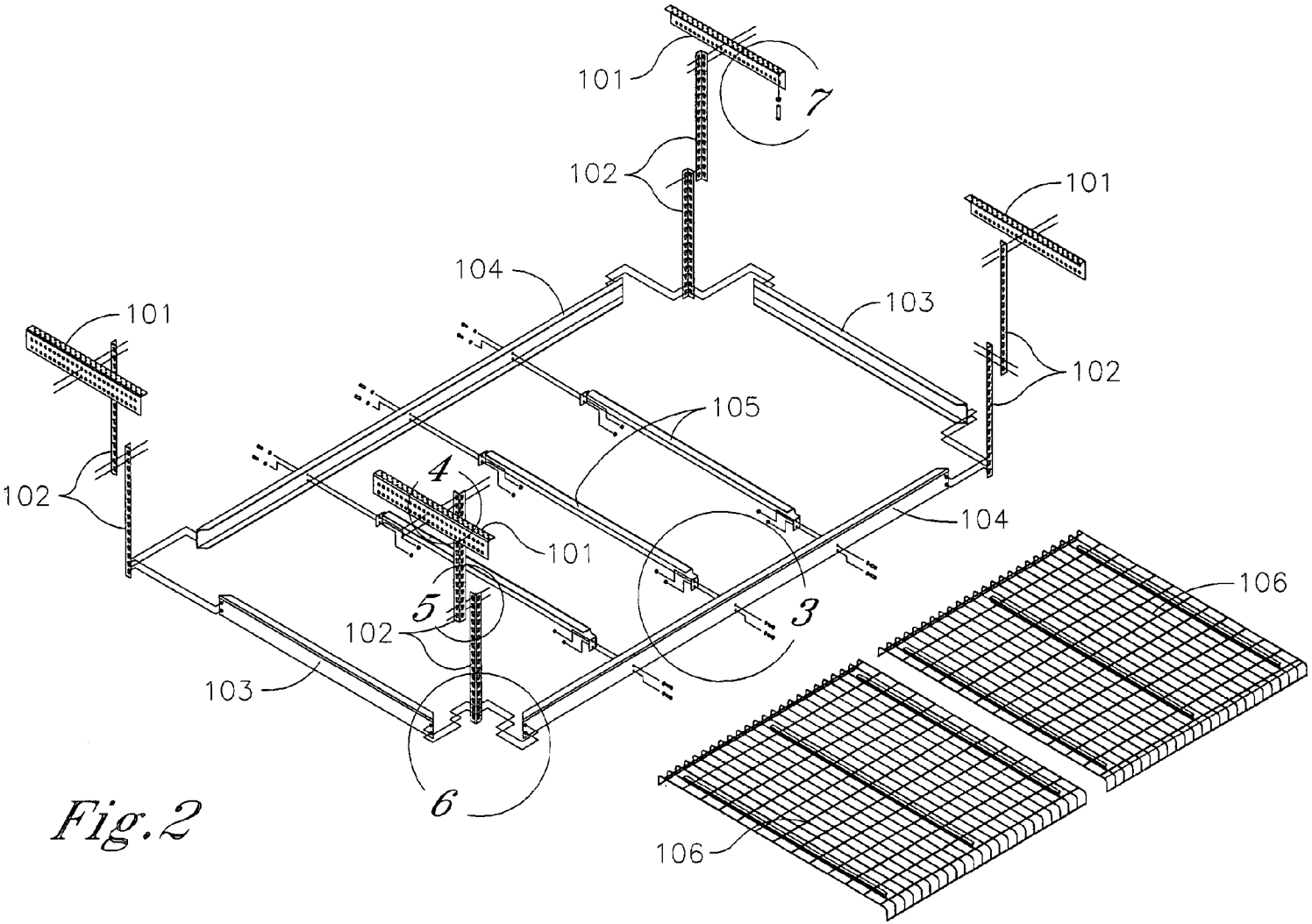
FIG. 2 is an exploded view of the invention as assembled
Figure 3:
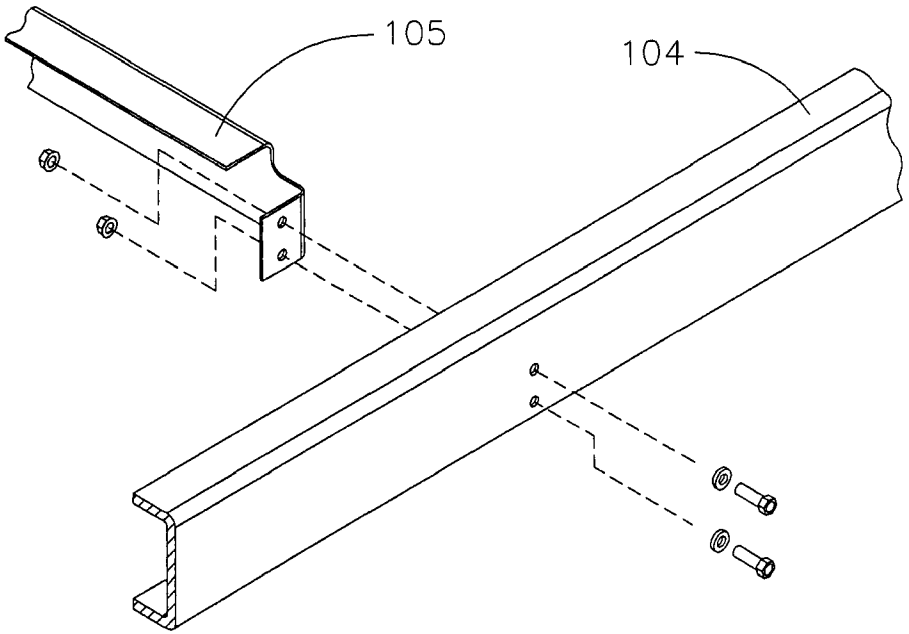
FIG. 3 is a detailed view of the assembly of the invention

FIG. 2 shows the assembly of the present invention 100. In close-up, FIG. 3 shows the hard connection via bolts and nuts between the frame 103,104 and a typical cross member 105. In the preferred embodiment, the angle iron for the frame 103,104 and for the cross member 105 is standard two-sided angle iron product. In an alternate embodiment, the longitudinal beam 104 in the frame 103,104 can be made from C-shaped-cross-section, three-sided angle iron product to provide greater strength and stiffness to the frame 103, 104. The C-shaped cross-section beam reduces the need for an intermediate riser, where that would be desirable, allowing for the storage of bulkier items.

Figure 4:
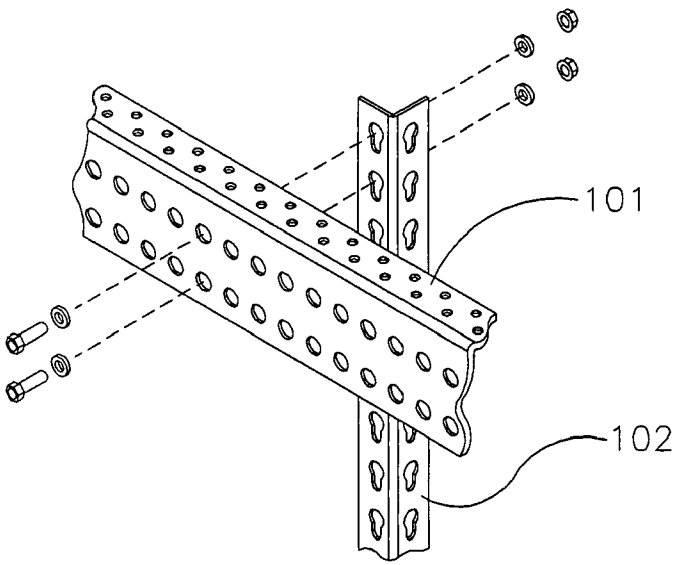
FIG. 4 is a detailed view of the assembly of the invention
Figure 7:
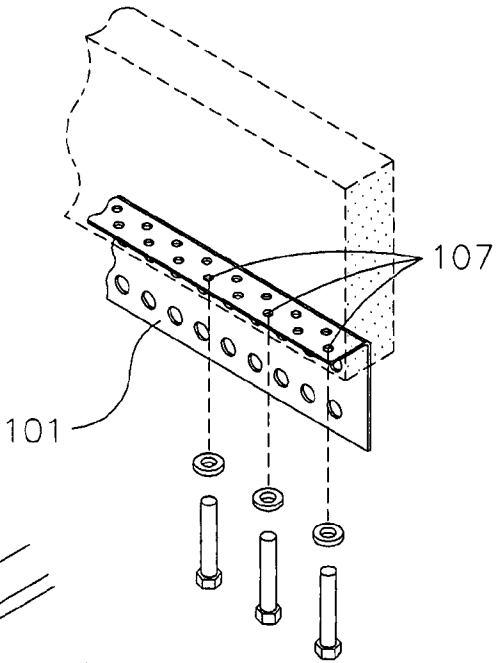
FIG. 7 shows the connection of the support members to a rafter

FIG. 4 shows the connection between the riser 102 and a ceiling attachment bracket 101. Note that the holes 107 through the bracket 101 are in two rows, staggered to provide a better opportunity for a connection to the overhead trusses in a ceiling. As in FIG. 7, large wood screws or bolts would be driven through the bracket holes 107 chosen to be close to the center of the truss to support the riser 102.

Figure 5:
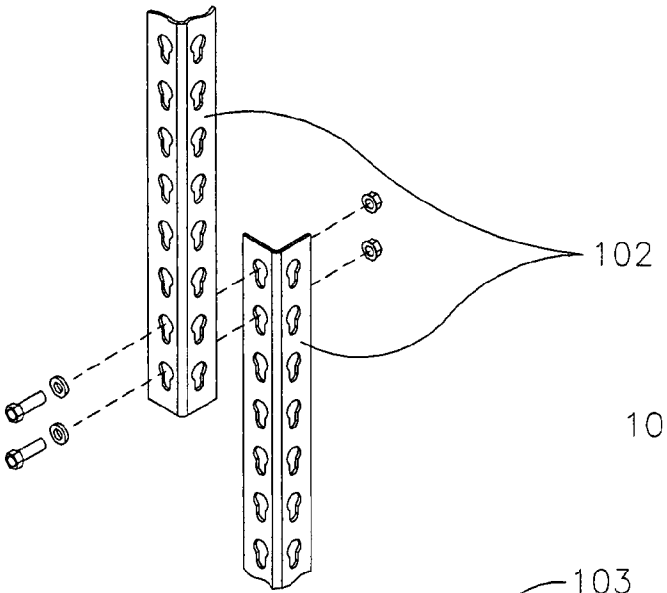
FIG. 5 shows the connection of the risers

In FIG. 5 the adjustable nature of the riser 102 is shown, with a two-bolt connection adjustable in small increments to accommodate slanted ceiling trusses, such as with a slanted roof.

Figure 6:
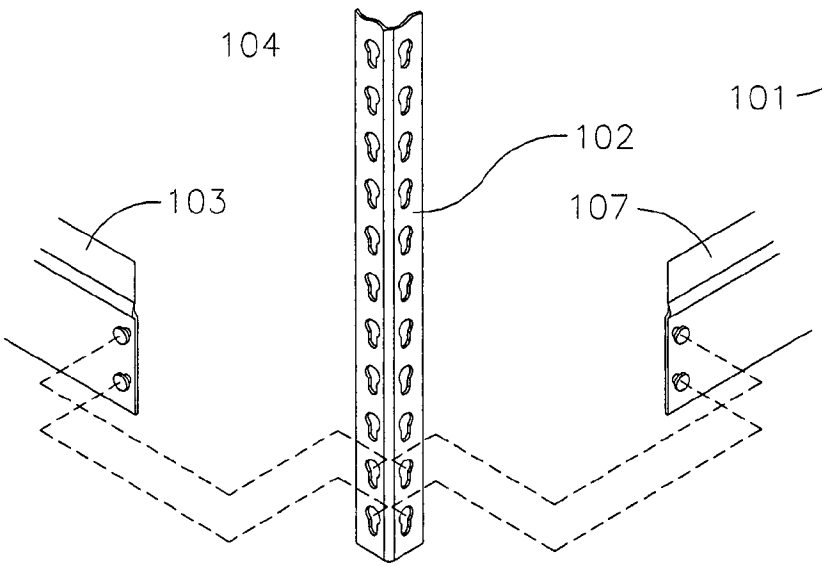
FIG. 6 shows the connection of the frame to the risers

FIG. 6 shows how the frame 103,104 comes together at the riser 102 angle iron connected with bolts.

Assembly of the invention would consist of selecting the ceiling airspace to be occupied by the storage area defined by the risers 102 and the metal mesh floor 106, identifying attachment points on ceiling trusses to attach the ceiling attachment brackets 101, attach said brackets 101 and than attach the risers 102. Adjust the riser 102 lengths so that a horizontal rectangle in the shape of the invention's 100 floor is defined, then attach the frame 103,104 components and cross members 105 as indicated. Last, place the metal mesh 106 floor on the frame.

While the foregoing describes a preferred embodiment, variation on this design and equivalent designs may be resorted to in the scope and spirit of the claimed invention.

What is claimed is:

1. A hanging storage system, comprising a plurality of attachment brackets, a plurality of risers, a rectangular frame, and a floor, said attachment brackets in the shape of flat, rectangular strips, the rectangular strips extending in length from 18 inches to 26 inches, the rectangular strips possessing a plurality of attachment holes, the attachment holes distributed in two staggered rows along the length of said strips, the risers comprised of two angled metal strips each, the angled metal strips possessing a plurality of riser adjustment holes, the riser adjustment holes positioned such that the two angled metal strips comprising each riser can be removably attached to each other by bolts passed through the riser adjustment holes, the rectangular frame comprised of two longitudinal beams, two transverse beams and a plurality of transverse ribs, the longitudinal beams, the transverse beams, and the transverse ribs comprised of angled metal product, the transverse beams and the longitudinal beams connected removably to each other in the shape of a rectangle, the transverse ribs connected removably at each end to rib attachment points along the length of the longitudinal beam, the transverse ribs extending from one longitudinal beam to the other parallel to the transverse beam and orthogonal to the longitudinal beam, the risers attached removably at one end to the attachment brackets and attached removably at the other end to the corners of the rectangular frame, the floor comprised of a rectangular piece of metal mesh cut in a shape that fits over the rectangular frame and is removably attached to the rectangular frame.

2. A hanging storage system as in claim 1, where the longitudinal beam is comprised of angled metal beams with a C-shaped cross-section.

* * * * *